US011199787B2

(12) United States Patent
Qi et al.

(10) Patent No.: US 11,199,787 B2
(45) Date of Patent: Dec. 14, 2021

(54) FLUORESCENT METALLIC TONERS AND RELATED METHODS

(71) Applicant: Xerox Corporation, Norwalk, CT (US)

(72) Inventors: Yu Qi, Penfield, NY (US); Jaclyn Janis, Rochester, NY (US); Judith Vandewinckel, Livonia, NY (US); Chunliang Lu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/822,263

(22) Filed: Mar. 18, 2020

(65) Prior Publication Data

US 2021/0294235 A1 Sep. 23, 2021

(51) Int. Cl.
*G03G 9/093* (2006.01)
*G03G 9/08* (2006.01)

(52) U.S. Cl.
CPC ..... *G03G 9/09371* (2013.01); *G03G 9/0804* (2013.01); *G03G 9/09328* (2013.01); *G03G 9/09385* (2013.01); *G03G 9/09392* (2013.01)

(58) Field of Classification Search
CPC ..... G03G 9/0804; G03G 9/09392
See application file for complete search history.

(56) References Cited

U.S. PATENT DOCUMENTS

| | | | | |
|---|---|---|---|---|
| 5,604,076 | A | 2/1997 | Patel et al. | |
| 6,413,692 | B1 | 7/2002 | Cheng | |
| 6,455,220 | B1 | 9/2002 | Cheng | |
| 8,541,154 | B2 | 9/2013 | Iftime et al. | |
| 8,810,630 | B2 | 8/2014 | Kim et al. | |
| 8,916,317 | B2 | 12/2014 | Iftime et al. | |
| 9,280,076 | B1 | 3/2016 | Li et al. | |
| 9,557,670 | B2 | 1/2017 | Shiba et al. | |
| 9,658,547 | B2 * | 5/2017 | Hara | G03G 9/0825 |
| 10,254,667 | B2 | 4/2019 | Tanaka et al. | |
| 2008/0090726 | A1 | 4/2008 | Eskra et al. | |
| 2009/0047593 | A1 | 2/2009 | Vanbesien et al. | |
| 2010/0135700 | A1 | 6/2010 | Mutoh et al. | |
| 2010/0173239 | A1 | 7/2010 | Iftime et al. | |
| 2010/0248118 | A1 | 9/2010 | Gong et al. | |
| 2011/0223528 | A1 | 9/2011 | Ohno et al. | |
| 2012/0021353 | A1 | 1/2012 | Nagasawa et al. | |
| 2012/0043504 | A1 | 2/2012 | Yang et al. | |
| 2012/0237868 | A1 | 9/2012 | Yamada et al. | |
| 2014/0197364 | A1 | 7/2014 | Richards-Johnson et al. | |
| 2014/0234765 | A1 * | 8/2014 | Hirai | G03G 15/0865 430/105 |
| 2014/0370438 | A1 | 12/2014 | Qui et al. | |
| 2017/0145236 | A1 | 5/2017 | Harada | |
| 2017/0285504 | A1 * | 10/2017 | Anno | G03G 9/0823 |
| 2018/0157184 | A1 | 6/2018 | Jan | |
| 2018/0258237 | A1 | 9/2018 | Smink et al. | |
| 2020/0002555 | A1 | 1/2020 | Marti Abril | |
| 2020/0073271 | A1 | 3/2020 | Satoru | |
| 2021/0141318 | A1 | 5/2021 | Flores et al. | |

FOREIGN PATENT DOCUMENTS

| | | | |
|---|---|---|---|
| EP | 1521128 | A2 | 4/2005 |
| EP | 2290454 | A1 | 3/2011 |
| EP | 3457214 | A1 | 8/2018 |
| JP | 1-101558 | | 10/1987 |
| JP | H01 201677 | | 8/1989 |
| JP | 200244336 | | 8/2002 |
| JP | 2005-208362 | | 8/2005 |
| JP | 2009-086331 | A | 4/2009 |
| WO | WO2011/013697 | A1 | 2/2011 |
| WO | WO 2018/190247 | A1 | 10/2018 |

OTHER PUBLICATIONS

Extended Search Report issued on European Application 21160585.2, dated Aug. 10, 2021.

* cited by examiner

*Primary Examiner* — Christopher D Rodee
(74) *Attorney, Agent, or Firm* — Bell & Manning, LLC

(57) ABSTRACT

Methods of making fluorescent metallic toners are provided which comprise forming one or more fluorescent latexes which comprise a fluorescent agent, a first type of amorphous resin, and a second type of amorphous resin, wherein the first and second types of amorphous resins are present at a ratio in a range of from 2:3 to 3:2; forming a mixture comprising the one or more fluorescent latexes; a dispersion comprising aluminum flakes and a surfactant; one or more emulsions which comprise a crystalline resin, the first type of amorphous resin, the second type of amorphous resin; and optionally, a wax dispersion; aggregating the mixture to form particles of a predetermined size; forming a shell over the particles of the predetermined size to form core-shell particles; and coalescing the core-shell particles to form a fluorescent metallic toner. Fluorescent metallic toners and methods of using such toners are also provided.

15 Claims, No Drawings

FLUORESCENT METALLIC TONERS AND RELATED METHODS

BACKGROUND

Conventional xerographic printing systems for toner applications consist of four stations comprising cyan, magenta, yellow, and black (CMYK) toner stations. Printing systems have been developed which include the concept of an additional xerographic station to enable gamut extension via the addition of other colors or specialty colors. At any given time, the machine can run CMYK toners plus an additional color in the fifth station. Metallic toners have been developed as a possible additional color. However, it has been challenging to improve upon the brightness and reflectance of existing metallic toners.

SUMMARY

The present disclosure provides fluorescent metallic toners, including fluorescent silver and fluorescent gold toners. Methods of making and using the toners are also provided.

In one aspect, methods of making fluorescent metallic toners are provided. In embodiments, such a method comprises forming one or more fluorescent latexes which comprise a fluorescent agent, a first type of amorphous resin, and a second type of amorphous resin, wherein the first and second types of amorphous resins are present at a ratio in a range of from 2:3 to 3:2; forming a mixture comprising the one or more fluorescent latexes; a dispersion comprising aluminum flakes and a surfactant; one or more emulsions which comprise a crystalline resin, the first type of amorphous resin, the second type of amorphous resin; and optionally, a wax dispersion; aggregating the mixture to form particles of a predetermined size; forming a shell over the particles of the predetermined size to form core-shell particles; and coalescing the core-shell particles to form a fluorescent metallic toner. Fluorescent metallic toners made using such methods are also provided.

In another aspect, fluorescent metallic toners are provided. In embodiments, such a fluorescent metallic toner comprises a core comprising a fluorescent agent-incorporated first type of amorphous polyester resin; a fluorescent agent-incorporated second type of amorphous polyester; encapsulated and homogenously distributed aluminum flakes; a crystalline polyester resin; an additional amount of the first type of amorphous polyester resin; an additional amount of the second type of the amorphous polyester resin; and optionally, a wax; and a shell over the core, the shell comprising the first type of amorphous polyester resin and the second type of the amorphous polyester resin. Methods of using such fluorescent metallic toners are also provided.

DETAILED DESCRIPTION

The present disclosure provides fluorescent metallic toners, including fluorescent silver and fluorescent gold toners. Methods of making and using the toners are also provided.

The fluorescent metallic toners comprise a core comprising aluminum flakes and a fluorescent agent dispersed within one or more polymeric resins, and a shell over the core, the shell also comprising one or more polymeric resins which may or may not be the same as the resin(s) within the core. Although some fluorescent toners have been developed, it is particularly challenging to incorporate fluorescent agents into a toner without negatively affecting the optical properties of the fluorescent agents. For example, the fluorescence of the fluorescent agents is easily quenched within the toner, resulting in the toner have little to no fluorescence. The present disclosure is based, at least in part, on the development of an improved toner preparation process that prevents such quenching and results in fluorescent metallic toners having high lightness L* values and which are highly reflective.

Aluminum Flakes

The present toners comprise aluminum flakes within the core of the toner. The aluminum flakes are generally encapsulated within the particles of the toner (i.e., the core-shell particles) such that no aluminum flakes are present at or on the surface of the particles. In embodiments, no aluminum flakes are present within or on the shell of the toner. Encapsulation may be confirmed using scanning, transmission electron microscopy (SEM/TEM) and X-ray photoelectron spectroscopy (XPS). The aluminum flakes are generally homogenously distributed throughout the resin matrix of the core of the particles of the toner. The distribution may also be confirmed using SEM/TEM.

The aluminum flakes are characterized by an average thickness and an average width (the width taken as the largest distance across the surface of the flake). In embodiments, the average thickness is in a range of from 1 μm to 10 μm, 6 μm to 10 μm, or 1 μm to 3 μm.

The amount of aluminum flakes present in the present toners may vary. In embodiments, the aluminum flakes are present at an amount in the range of from 5 weight % to 30 weight % by weight of the toner. This includes an amount of from 10 weight % to 30 weight %, and from 15 weight % to 25 weight %.

Fluorescent Agents

The present toners further comprise a fluorescent agent within the core of the toner. In embodiments, the fluorescent agent is an ultraviolet (UV) fluorescent agent that absorbs light having a wavelength in the UV portion of the electromagnetic spectrum (from 10 nm to 400 nm). This includes fluorescent agents having a maximum absorption in the UV portion of the electromagnetic spectrum. This includes fluorescent agents having maximum absorption in a range of from 330 nm to 370 nm, from 340 nm to 360 nm, or from 345 nm to 355 nm. These wavelength ranges may refer to the location of the peak in the fluorescence emission.

For fluorescent silver toners, the fluorescent agent is one that emits (upon illumination with UV light, which may include sunlight) fluorescence having a wavelength in a range of from 345 nm to 470 nm, from 400 to 470 nm, from 420 nm to 470 nm, from 420 nm to 460 nm, or from 345 nm to 450 nm. Illustrative fluorescent agents for fluorescent silver toners include the following: 2,5-Thiophenediylbis(5-tert-butyl-1,3-benzoxazole), 4,4'-Stilbenedicarboxylic acid, 4,4'-Bis(5-methyl-2-benzoxazolyl)stilbene, 2-[4-[2-[4-(Benzoxazol-2-yl)phenyl]vinyl]phenyl]-5-methylbenzoxazol, 1-(2-Cyanostyryl)-4-(4-cyanostyryl)benzene, 4,4-Bis(diethylphosphonomethyl)biphenyl, ACENAPHTHYLENE, 1,2-bis(5-methyl-2-benzoxazole) ethylene; 2,2'-(1,2-ethenediyl)bis[5-methylbenzoxazole], 2,2'-(1,2-Ethenediyldi-4,1-phenylene)bisbenzoxazole, 4-Bis(1,3-benzoxazol-2-yl)naphthalene, 2-Chlorobenzyl cyanide, Oxazole, 2-(Chloromethyl)benzonitrile, 2,5-Thiophenedicarboxylic acid, 4-tert-Butyl-2-nitrophenol, Fluorescent Brightener 28, Fluorescent Brightener 220, 2-tert-Butyl-1,4-benzoquinone, 2,5-Bis(benzoxazol-2-yl)thiophene; 2,2'-(2,5-thiophenediyl)bis-benzoxazol, Fluorescent Brightener 9, Fluorescent Whitening Agent VBL, Fluorescent Brightener Pf, Fluorescent brightener 135, 4,4'-bis[2-(2-sulfophenyl)ethenyl]biphenyl, 4-Nitronaphthalene-1,8-dicarboxylic anhydride, Fluorescent Brightener 191, Fluorescent Brightener 204, 2-[2-[4-[2-(3-cyanophenyl)ethenyl]phenyl]ethenyl]-benzonitrile, Fluorescent brightener 378, 5-BENZOXAZOLOL, 2-METHYL-. Combinations of different fluorescent agents may be used. In embodiments, the fluorescent agent is Fluorescent Brightener 184, Fluorescent Brightener 185, Fluorescent Brightener 367, or combinations thereof.

Fluorescent gold toners comprise both a red fluorescent agent and a yellow fluorescent agent within the core of the toner. The red fluorescent agent generally emits (upon illumination with UV light, which may include sunlight) fluorescence having a wavelength in a range of from 600 nm to 630 nm. This wavelength range may refer to the location of the peak in the fluorescence emission. The yellow fluorescent agent generally emits (upon illumination with UV light) fluorescence having a wavelength in a range of from 510 nm to 540 nm. This wavelength range may refer to the location of the peak in the fluorescence emission.

Illustrative red fluorescent agents include Solvent Red 49, Solvent Red 149, Solvent Red 196, Solvent Red 197, and Solvent Red 242. Generally, the red fluorescent agent is not a water-soluble red dye, e.g., basic red 1:1 or basic red 1. Illustrative yellow fluorescent agents include Solvent Yellow 160:1, Solvent Yellow 98, Solvent Yellow 172, Solvent Yellow 171, Solvent Yellow 185, Solvent Yellow 145, Solvent Yellow 85, Solvent Yellow 44, Solvent Yellow 195, Solvent Yellow 196, and the like. Generally, the yellow fluorescent agent is not a water-soluble yellow dye, e.g., basic yellow 40. Combinations of different types of red fluorescent agents and combinations of different types of yellow fluorescent agents may be used.

Generally, no other fluorescent agents are included in the toners, i.e., in embodiments, the only fluorescent agents in the toners are those selected from those listed above. Generally, no pigments (other than the aluminum flakes as the colorants) are included in the toners, i.e., in embodiments, the toners are free from any pigments.

Like the aluminum flakes, the fluorescent agents are generally encapsulated within the particles of the toner (i.e., the core-shell particles) such that no fluorescent agent is present at or on the surface of the particles. In embodiments, no fluorescent agent is present within or on the shell of the toner. Similarly, the fluorescent agents are generally homogenously distributed throughout the resin matrix of the core of the particles of the toner. As noted above and further described below, it is challenging to prevent fluorescence quenching when fluorescent agents are combined with other components such as in toner particles. However, the present disclosure is based, at least in part, upon the development of a toner preparation process that achieves a homogeneous distribution of fluorescent agents and encapsulation as well as addresses the problem of quenching. As further described below, the process involves the use of a separate latex(es) comprising the fluorescent agents and two amorphous resins (each a different type of amorphous resin) in forming the core of the toner particles.

For fluorescent silver toners, the fluorescent agent may be present in the toner in an amount of, for example, from 0.2 weight % to 2 weight % by weight of the toner, 0.2 weight % to 1.5 weight % by weight of the toner, or 0.2 weight % to 1.0 weight % by weight of the toner. If more than one type of fluorescent agent is used, these amounts refer to the total amount of fluorescent agent in the toner.

For fluorescent gold toners, the red fluorescent agent may be present in the toner in an amount of, for example, from 0.5 weight % to 3 weight % by weight of the toner, 0.5 weight % to 2.0 weight % by weight of the toner, or 0.5 weight % to 1.0 weight % by weight of the toner. The yellow fluorescent agent may be present in the toner in an amount of, for example, from 0.5 weight % to 3 weight % by weight of the toner, 0.5 weight % to 2.0 weight % by weight of the toner, or 0.5 weight % to 1.0 weight % by weight of the toner. The relative amounts of the red and yellow fluorescent agent may be that which provides a ratio of red:yellow of from 1:10 to 1:2. If more than one type of red (or yellow) fluorescent agent is used, these amounts refer to the total amount of red (or yellow) fluorescent agent in the toner.

Resins

The present toners may comprise a variety of resins, which provides a polymeric matrix to contain both the aluminum flakes and the fluorescent agent described above. The present toners may comprise more than one different type of resin. The resin may be an amorphous resin, a crystalline resin, or a mixture of crystalline and amorphous resins. The resin may be a polyester resin, including an amorphous polyester resin, a crystalline polyester resin, or a mixture of crystalline polyester and amorphous polyester resins.

Crystalline Resin

The resin may be a crystalline polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, combinations thereof, and the like including their structural isomers. The aliphatic diol may be, for example, selected in an amount of from about 40 to about 60 mole percent of the resin, from about 42 to about 55 mole percent of the resin, or from about 45 to about 53 mole percent of the resin, and a second diol may be selected in an amount of from about 0 to about 10 mole percent of the resin or from about 1 to about 4 mole percent of the resin.

Examples of organic diacids or diesters including vinyl diacids or vinyl diesters selected for the preparation of crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, from about 40 to about 60 mole percent of the resin, from about 42 to about 52 mole percent of the resin, or from about 45 to about 50 mole percent of the resin, and a second diacid can be selected in an amount of from about 0 to about 10 mole percent of the resin.

Polycondensation catalysts which may be utilized in forming crystalline (as well as amorphous) polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate), and mixtures thereof. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), poly(propylene-sebecamide), and mixtures thereof. Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), poly(butylene-succinimide), and mixtures thereof.

In embodiments, the crystalline polyester resin has the following formula (I)

(I)

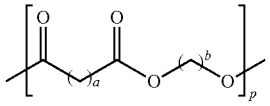

wherein each of a and b may range from 1 to 12, from 2 to 12, or from 4 to 12 and further wherein p may range from 10 to 100, from 20 to 80, or from 30 to 60. In embodiments, the crystalline polyester resin is poly(1,6-hexylene-1,12-dodecanoate), which may be generated by the reaction of dodecanedioc acid and 1,6-hexanediol.

As noted above, the disclosed crystalline polyester resins may be prepared by a polycondensation process by reacting suitable organic diols and suitable organic diacids in the presence of polycondensation catalysts. A stoichiometric equimolar ratio of organic diol and organic diacid may be utilized, however, in some instances where the boiling point of the organic diol is from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized may vary, and can be selected in amounts, such as for example, from about 0.01 to about 1 or from about 0.1 to about 0.75 mole percent of the crystalline polyester resin.

The crystalline resin may be present, for example, in an amount of from about 1% to about 85 weight % by weight of the toner, from about 5 weight % to about 50 weight % by weight of the toner, or from about 10 weight % to about 35 weight % by weight of the toner.

The crystalline resin can possess various melting points of, for example, from about 30° C. to about 120° C., from about 50° C. to about 90° C., or from about 60° C. to about 80° C. The crystalline resin may have a number average molecular weight ($M_n$), as measured by gel permeation chromatography (GPC) of, for example, from about 1,000 to about 50,000, from about 2,000 to about 25,000, or from about 5,000 to about 20,000, and a weight average molecular weight ($M_w$) of, for example, from about 2,000 to about 100,000, from about 3,000 to about 80,000, or from about 10,000 to about 30,000, as determined by GPC. The molecular weight distribution ($M_w/M_n$) of the crystalline resin may be, for example, from about 2 to about 6, from about 3 to about 5, or from about 2 to about 4.

Amorphous Resin

The resin may be an amorphous polyester resin formed by reacting a diol with a diacid in the presence of an optional catalyst. Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethyl succinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, from about 42 to about 52 mole percent of the resin, or from about 45 to about 50 mole percent of the resin.

Examples of diols which may be utilized in generating an amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diols selected may vary, for example, the organic diols may be present in an amount from about 40 to about 60 mole percent of the resin, from about 42 to about 55 mole percent of the resin, or from about 45 to about 53 mole percent of the resin.

Examples of suitable amorphous resins include polyesters, polyamides, polyimides, polyolefins, polyethylene, polybutylene, polyisobutyrate, ethylene-propylene copolymers, ethylene-vinyl acetate copolymers, polypropylene, and the like, and mixtures thereof.

An unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

A suitable polyester resin may be an amorphous polyester such as a poly(propoxylated bisphenol A co-fumarate) resin. Examples of such resins and processes for their production include those disclosed in U.S. Pat. No. 6,063,827, the disclosure of which is hereby incorporated by reference in its entirety.

Suitable polyester resins include amorphous acidic polyester resins. An amorphous acid polyester resin may be based on any combination of propoxylated bisphenol A, ethoxylated bisphenol A, terephthalic acid, fumaric acid, and dodecenyl succinic anhydride, such as poly(propoxylated bisphenol-co-terephthlate-fumarate-dodecenylsuccinate). Another amorphous acid polyester resin which may be used is poly(propoxylated-ethoxylated bisphenol-co-terephthalate-dodecenylsuccinate-trimellitic anhydride).

An example of a linear propoxylated bisphenol A fumarate resin which may be utilized as a resin is available under the trade name SPAMII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

An amorphous resin or combination of amorphous resins may be present, for example, in an amount of from about 5 weight % to about 95 weight % by weight of the toner, from about 30 weight % to about 90 weight % by weight of the toner, or from about 35 weight % to about 85 weight % by weight of the toner.

The amorphous resin or combination of amorphous resins may have a glass transition temperature of from about 30° C. to about 80° C., from about 35° C. to about 70° C., or from about 40° C. to about 65° C. The glass transition temperature may be measured using differential scanning calorimetry (DSC). The amorphous resin may have a $M_n$, as measured by GPC of, for example, from about 1,000 to about 50,000, from about 2,000 to about 25,000, or from about 1,000 to about 10,000, and a $M_w$ of, for example, from about 2,000 to about 100,000, from about 5,000 to about 90,000, from about 10,000 to about 90,000, from about 10,000 to about 30,000, or from about 70,000 to about 100,000, as determined by GPC.

One, two, or more resins may be used in the present toners. Where two or more resins are used, the resins may be in any suitable ratio (e.g., weight ratio) such as for instance of from about 1% (first resin)/99% (second resin) to about 99% (first resin)/1% (second resin), from about 10% (first resin)/90% (second resin) to about 90% (first resin)/10% (second resin). Where the resins include a combination of amorphous and crystalline resins, the resins may be in a weight ratio of, for example, from about 1% (crystalline resin)/99% (amorphous resin) to about 99% (crystalline resin)/1% (amorphous resin), or from about 10% (crystalline resin)/90% (amorphous resin) to about 90% (crystalline resin)/10% (amorphous resin). In some embodiments, the weight ratio of the resins is from about 80 weight % to about 60 weight % of the amorphous resin and from about 20 weight % to about 40 weight % of the crystalline resin. In such embodiments, the amorphous resin may be a combination of amorphous resins, e.g., a combination of two amorphous resins.

The resin(s) in the present toners may possess acid groups which may be present at the terminal of the resin. Acid groups which may be present include carboxylic acid groups, and the like. The number of carboxylic acid groups may be controlled by adjusting the materials utilized to form the resin and reaction conditions. In embodiments, the resin is a polyester resin having an acid number from about 2 mg KOH/g of resin to about 200 mg KOH/g of resin, from about 5 mg KOH/g of resin to about 50 mg KOH/g of resin, or from about 5 mg KOH/g of resin to about 15 mg KOH/g of resin. The acid containing resin may be dissolved in tetrahydrofuran solution. The acid number may be detected by titration with KOH/methanol solution containing phenolphthalein as the indicator. The acid number may then be calculated based on the equivalent amount of KOH/methanol required to neutralize all the acid groups on the resin identified as the end point of the titration.

Wax

Optionally, a wax may be included in the present toners. A single type of wax or a mixture of two or more different waxes may be used. A single wax may be added, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1 weight % to about 25 weight % by weight of the toner or from about 5 weight % to about 20 weight % by weight of the toner particles.

When a wax is used, the wax may include any of the various waxes conventionally used in emulsion aggregation toners. Waxes that may be selected include waxes having, for example, an average molecular weight of from about 500 to about 20,000 or from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polymethylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethylene glycol monostearate, dipropylene glycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

Toner Preparation Process

In order to form the present toners, any of the resins described above may provided as an emulsion(s), e.g., by using a solvent-based phase inversion emulsification process. The emulsions may then be utilized as the raw materials to form the toners, e.g., by using an emulsion aggregation and coalescence (EA) process. However, the toners may be prepared using other processes.

In order to achieve encapsulation and a homogeneous distribution of the aluminum flakes, a separate dispersion comprising the aluminum flakes and a surfactant are generally used in the toner preparation process. Illustrative surfactants include anionic surfactants such as diphenyl oxide disulfonate, ammonium lauryl sulfate, sodium dodecyl benzene sulfonate, dodecyl benzene sulfonic acid, sodium alkyl naphthalene sulfonate, sodium dialkyl sulfosuccinate, sodium alkyl diphenyl ether disulfonate, potassium salt of alkylphosphate, sodium polyoxyethylene lauryl ether sulfate, sodium polyoxyethylene alkyl ether sulfate, sodium polyoxyethylene alkyl ether sulfate, triethanolamine polyoxyethylene alkylether sulfate, sodium naphthalene sulfate, and sodium naphthalene sulfonate formaldehyde condensate, and mixtures thereof; and nonionic surfactants such as polyvinyl alcohol, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene nonylphenyl ether, polyoxyethylene oleyl ether, polyoxyethylene sorbitan monolaurate, polyoxyethylene stearyl ether, dialkylphenoxy poly(ethyleneoxy)ethanol, and mixtures thereof. However, in embodiments, the surfactant is dodecyl benzene sulfonic acid and this surfactant is present in the separate dispersion at an amount in a range of from 1.5 weight % to 4 weight % by weight as compared to the amount of the aluminum flakes. This surfactant and these amounts are useful to achieved encapsulation and homogeneous distribution of the aluminum flakes. The aluminum flakes, once incorporated into the toner particles using this surfactant and these amounts, may be referred to as "encapsulated and homogeneously distributed" aluminum flakes. As noted above, encapsulation and homogeneous distribution may be confirmed using SEM/TEM/XPS.

As noted above, in order to achieve similar encapsulation and homogeneous distribution of the fluorescent agents as well as to prevent fluorescence quenching, a separate latex (a fluorescent latex) comprising the fluorescent agents is generally used in the preparation process. One separate latex comprising the desired fluorescent agents and the desired amorphous resins may be used or multiple separate latexes may be used (e.g., for fluorescent gold toners, one separate latex comprising a red fluorescent agent and the two types of amorphous resins and another separate latex comprising a yellow fluorescent agent and the two types of amorphous resins, etc.). Either way, the latex(es) being used to form the toner provide the fluorescent agents and two amorphous resins (each a different type of amorphous resin), wherein these latex(es) provide the two amorphous resins in a weight ratio of from 2:3 to 3:2. This includes a weight ratio of 1:1. That is, if more than one latex is used, together, the latex(es) provide the two amorphous resins within this range of weight ratios. It has been found that these ranges are important for obtaining encapsulation and a homogeneous distribution of the fluorescent agents in the toner particles as well as to prevent fluorescence quenching. Outside these ranges the fluorescent properties of the toner deteriorate, due at least in part, to quenching of the fluorescence. In embodiments, the amorphous resins are amorphous polyester resins. In embodiments, one of the amorphous resins has an $M_n$ or $M_w$ that is greater than the other.

In addition, to prevent fluorescence quenching, it is useful to use an amount of the fluorescent agents in the fluorescent latex in a range of from 1.5 weight % to 8 weight % by weight as compared to the total weight of the fluorescent latex. Outside this range, the fluorescent properties of the toner deteriorate, due at least in part, to quenching of the fluorescence. If the fluorescent latex includes more than one type of fluorescent agent, these amounts refer to the total amount of fluorescent agents in the toner.

The fluorescent agents/amorphous resins, once incorporated into the toner particles using the process and fluorescent agent amounts immediately described above, may be referred to as "fluorescent agent-incorporated amorphous resins". The fluorescence and optical properties of the resulting toner may be confirmed using an in-line spectrophotometer (ILS), e.g., an X-Rite ILS, to measure lightness L* and reflectance as described in the Example, below.

If a resin is incorporated into the toner particles using an emulsion free of a fluorescent agent, that resin may be referred to as a resin not incorporated with the fluorescent agent, or simply as the "resin," i.e., not modified with the phrase "fluorescent agent-incorporated."

If a wax is used, it may be incorporated into the toner as a separate dispersion of the wax in water.

In embodiments, the present toners are prepared by EA processes, such as by a process that includes aggregating a mixture of an emulsion comprising resin; the aluminum flakes; the fluorescent agent(s); and optionally, a wax; and then coalescing the mixture. As described above, the aluminum flakes are generally provided to the mixture as a separate dispersion. Similarly, the fluorescent agent(s) is generally provided to the mixture as one or more separate fluorescent latexes as described above. The emulsion comprising the resin may comprise one or more resins or different resins may be provided as different emulsions. The emulsion(s) comprising the resin generally do not comprise and thus, are free of the fluorescent agents.

Next, the mixture may be homogenized which may be accomplished by mixing at about 600 to about 6,000 revolutions per minute. Homogenization may be accomplished by any suitable means, including, for example, an IKA ULTRA TURRAX T50 probe homogenizer. An aggregating agent may be added to the mixture when the pH of the mixture was adjusted to below 5. Any suitable aggregating agent may be utilized. Suitable aggregating agents include, for example, aqueous solutions of a divalent cation or a multivalent cation material. The aggregating agent may be, for example, an inorganic cationic aggregating agent such as a polyaluminum halide such as polyaluminum chloride (PAC), or the corresponding bromide, fluoride, or iodide; a polyaluminum silicate such as polyaluminum sulfosilicate (PASS); or a water soluble metal salt including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, and copper sulfate; or combinations thereof. The aggregating agent may be added to the mixture at a temperature that is below the glass transition temperature ($T_g$) of the resin (s). The aggregating agent may be added to the mixture under homogenization.

The aggregating agent may be added to the mixture in an amount of, for example, from about 0 weight % to about 10 weight % by weight of the total amount of resin, from about 0.2 weight % to about 8 weight % by weight of the total amount of resin, or from about 0.5 weight % to about 5 weight % by weight of the total amount of resin.

The particles of the mixture may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for volume average particle size. The aggregation thus may proceed by maintaining an elevated temperature, or slowly raising the temperature to, for example, in embodiments, from about 30° C. to about 100° C., in embodiments from about 30° C. to about 80° C., or in embodiments from about 30° C. to about 50° C. The temperature may be held for a period time of from about 0.5 hours to about 6 hours, or in embodiments from about hour 1 to about 5 hours, while stirring, to provide the aggregated particles. Once the predetermined desired particle size is reached, a shell may be added. The volume average particle size of the particles prior to application of a shell may be, for example, from about 3 μm to about 10 μm, in embodiments, from about 4 μm to about 9 μm, or from about 6 μm to about 8 μm.

Shell Resin

After aggregation, but prior to coalescence, a resin coating may be applied to the aggregated particles to form a shell thereover. Any of the resins described above may be utilized in the shell. In embodiments, an amorphous polyester resin is utilized in the shell. In embodiments, two amorphous polyester resins are utilized in the shell. In embodiments, a crystalline polyester resin and two different types of amorphous polyester resins are utilized in the core and the same two types of amorphous polyester resins are utilized in the shell.

The shell may be applied to the aggregated particles by using the shell resins in the form of emulsion(s) as described above. Such emulsions may be combined with the aggregated particles under conditions sufficient to form a coating over the aggregated particles. For example, the formation of the shell over the aggregated particles may occur while heating to a temperature of from about 30° C. to about 80° C. or from about 35° C. to about 70° C. The formation of the shell may take place for a period of time from about 5 minutes to about 10 hours or from about 10 minutes to about 5 hours.

Once the desired size of the toner particles is achieved, the pH of the mixture may be adjusted with a pH control agent, e.g., a base, to a value of from about 3 to about 10, or in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, a chelating agent such as ethylene diamine tetraacetic acid (EDTA) may be added to help adjust the pH to the desired values noted above. Other chelating agents may be used.

In embodiments, the size of the core-shell toner particles (prior to coalescence) may be from about 3 μm to about 10 μm, from about 4 μm to about 10 μm, or from about 6 μm to about 9 μm.

Coalescence

Following aggregation to the desired particle size and application of the shell, the particles may then be coalesced to the desired final shape, the coalescence being achieved by, for example, heating the mixture to a temperature of from about 45° C. to about 150° C., from about 55° C. to about 99° C., or about 60° C. to about 90° C., which may be at or above the glass transition temperature of the resins utilized to form the toner particles. Heating may continue or the pH of the mixture may be adjusted (e.g., reduced) over a period of time to reach the desired circularity. The period of time may be from about 1 hours to about 5 hours or from about 2 hours to about 4 hours. Various buffers may be used during coalescence. The total time period for coalescence may be from about 1 to about 9 hours, from about 1 to about 8 hours, or from about 1 to about 5 hours. Stirring may be utilized during coalescence, for example, from about 20 rpm to about 1000 rpm or from about 30 rpm to about 800 rpm.

After aggregation and/or coalescence, the mixture may be cooled to room temperature. The cooling may be rapid or slow, as desired. A suitable cooling process may include introducing cold water to a jacket around the reactor. After cooling, the toner particles may be screened with a sieve of a desired size, filtered, washed with water, and then dried. Drying may be accomplished by any suitable process for drying including, for example, freeze-drying.

Other Additives

In embodiments, the present toners may also contain other optional additives. For example, the toners may include positive or negative charge control agents. Surface additives may also be used. Examples of surface additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids such as zinc stearate, calcium stearate, and magnesium stearate, mixtures thereof and the like; long chain alcohols such as UNILIN 700; and mixtures thereof. Each of these surface additives may be present in an amount of from about 0.1 weight % to about 5 weight % by weight of the toner or from about 0.25 weight % by weight to about 3 weight % by weight of the toner.

Toner Properties

In embodiments, the dry toner particles, exclusive of external surface additives, exhibit one or more of the following characteristics:

(1) Volume average particle size of from about 5.0 μm to about 12.0 μm, from about 6.0 μm to about 12.0 μm, or from about 8.0 μm to about 12.0 μm.

(2) Circularity of from about 0.90 to about 1.00, from about 0.92 to about 0.99, or from about 0.93 to about 0.97.

These characteristics may be measured according to the techniques described in the Example, below.

In embodiments, the dry toner particles, exclusive of external surface additives, exhibit one or more of the following characteristics:

(3) For fluorescent silver toners, a lightness L* of at least 66, at least 67, or at least 68, or in a range of from 66 to 69 at a toner mass per area (TMA) of 0.65 mg/cm$^2$. For fluorescent gold toners, a lightness L* of at least 64, at least 65, or at least 66, or in a range of from 64 to 67 at a toner mass per area (TMA) of 0.65 mg/cm$^2$.

(4) For fluorescent silver toners, a reflectance (at a TMA of 0.45 mg/cm$^2$) of at least 45 between a range of from 430 nm to 440 nm, of at least 46 between this wavelength range, at least 47 between this wavelength range, or in a range of from 45 to 50 between this wavelength range. For fluorescent gold toners, a reflectance (at a TMA of 0.45 mg/cm$^2$) of at least 30 between a range of from 500 nm to 600 nm, at least 35 between this wavelength range, at least 40 between this wavelength range, at least 45 between this wavelength range or in a range of from 30 to 50 between this wavelength range.

Regarding lightness L*, the CIELAB color space (also known as CIE L*a*b* or sometimes abbreviated as simply "Lab" color space) is a color space defined by the International Commission on Illumination (CIE). It expresses color as three values: L* for the lightness from black (0) to white (100), a* from green (−) to red (+), and b* from blue (−) to yellow (+).

Because three parameters are measured, the space itself is a three-dimensional real number space, which allows for infinitely many possible colors. In practice, the space is usually mapped onto a three-dimensional integer space for digital representation, and thus the L*, a*, and b* values are usually absolute, with a pre-defined range. The lightness value, L*, represents the darkest black at L*=0, and the brightest white at L*=100. The color channels, a* and b*, represent true neutral gray values at a*=0 and b*=0. The a* axis represents the green-red component, with green in the negative direction and red in the positive direction. The b* axis represents the blue-yellow component, with blue in the negative direction and yellow in the positive direction. The scaling and limits of the a* and b* axes will depend on the specific implementation, but they often run in the range of ±100 or −128 to +127 (signed 8-bit integer).

Both lightness L* and reflectance may be measured using an ILS such as an X-Rite ILS, operated in accordance with the manufacturer's instructions. Two settings that are typically used with the X-Rite ILS to measure Lab values are M0 (white light and undefined UV) and M1 (white light and defined UV). M0 is most commonly used for assessing base color. M1 is most commonly used for assessing a measure of fluorescence. The M1 setting is used to obtain the L* and reflectance values for the present toners described above.

These characteristics may be measured according to the techniques described in the Example, below.

Developers and Carriers

The present toners may be formulated into a developer composition. Developer compositions can be prepared by mixing the toners of the present disclosure with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The toners may be present in the carrier in amounts of from about 1% to about 15% by weight, from about 2% to about 8% by weight, or from about 4% to about 6% by weight. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Applications

The present toners may be used in a variety of xerographic processes and with a variety of xerographic printers. A xerographic imaging process includes, for example, preparing an image with a xerographic printer comprising a charging component, an imaging component, a photoconductive component, a developing component, a transfer component, and a fusing component. In embodiments, the development component may include a developer prepared by mixing a carrier with any of the toners described herein. The xerographic printer may be a high-speed printer, a black and white high-speed printer, a color printer, and the like. Once the image is formed with the toners/developers, the image may then be transferred to an image receiving medium such as paper and the like. Fuser roll members may be used to fuse the toner to the image-receiving medium by using heat and pressure.

Example

The following Example is being submitted to illustrate various embodiments of the present disclosure. The Example is intended to be illustrative only and is not intended to limit the scope of the present disclosure. Also, parts and percentages are by weight unless otherwise indicated. As used throughout this patent specification, "room temperature" refers to a temperature of from 20° C. to 25° C.

Silver Toner Preparation.

First, a fluorescent latex was prepared as follows. A mixture of 120 g of a first type of an amorphous polyester resin, 120 g of a second type of an amorphous polyester resin, and 7.2 g of a fluorescent agent was dissolved in a mixture of ethyl acetate, isopropyl-alcohol and aqueous ammonia solution with a ratio of (145/48/40 g) in a 2 L reactor at 60° C. To this mixture was added 500 g deionized water containing a surfactant (Calfax DB-45 from Pilot Chemical Company) to form an emulsion. The reactor was charged a distillation column and the organic solvent was distilled off. Finally, the resulting emulsion was filtered through a 25 μm sieve. The emulsion had an average particle size of 218 nm, and the solids content was about 41 weight %. The fluorescent agent content in the emulsion was about 3 weight %.

Next, fluorescent silver toner particles were prepared as follows. A dispersion of aluminum flake pigment (45 g) with an anionic surfactant in deionized water was stirred for 2 hours at room temperature. A mixture was formed by combining the following: the fluorescent latex; a first emulsion comprising a crystalline polyester resin; a second emulsion comprising the first type of amorphous polyester resin; and a third emulsion comprising the second type of amorphous polyester resin. This mixture and an aluminum sulfate (ALS) solution was added to the aluminum flake dispersion portion by portion while the reaction temperature was increased from 40° C. to 48° C. After a period of time, an emulsion containing the two amorphous polyester resins was added to form a shell over the particles. After the aggregation was completed, the particle dispersion was frozen with a chelation agent at pH about 8. The mixture was then heated up to 84° C. to coalesce. When the circularity reached 0.940, the batch was quenched at below 40° C. The resulting silver toner particles were washed with deionized water and freeze-dried to powder.

The fluorescent silver toner particles had about 20 weight % aluminum flakes and 0.6 weight % fluorescent agent. A comparative silver toner was prepared, also using aluminum flakes (at 20 weight %), but without any fluorescent agent.

Gold Toner Preparation.

First, fluorescent latexes were prepared as follows. A red fluorescent latex was prepared from a mixture of 120 g of a first type of an amorphous polyester resin, 120 of a second type of an amorphous polyester resin, and 2 weight % of a red fluorescent agent dissolved in a mixture of ethyl acetate, isopropyl-alcohol and aqueous ammonia solution with a ratio of (145/48/40 g) in a 2 L reactor at 60° C. To this mixture was added 500 g deionized water containing a surfactant (Calfax DB-45 from Pilot Chemical Company) to form an emulsion. The reactor was charged a distillation column and the organic solvent was distilled off. Finally, the resulting emulsion was filtered through a 25 μm sieve. The emulsion had an average particle size of 200, and the solids content was about 40 weight %. The red fluorescent agent content in the emulsion was about 2 weight %. A yellow fluorescent latex was similarly prepared, but using 2 weight % of a yellow fluorescent agent. The resulting emulsion had an average particle size of 200, and the solids content was about 40 weight %.

Next, fluorescent gold toner particles were prepared as follows. A dispersion of aluminum flake pigment (45 g) with an anionic surfactant in deionized water was stirred for 2 hours at room temperature. A mixture was formed by combining the following: the red fluorescent latex; the yellow fluorescent latex; a first emulsion comprising a crystalline polyester resin; a second emulsion comprising the first type of amorphous polyester resin; and a third emulsion comprising the second type of amorphous polyester resin. This mixture and an aluminum sulfate (ALS) solution was added to the aluminum flake dispersion portion by portion while the reaction temperature was increased from 40° C. to 48° C. After a period of time, an emulsion containing the two amorphous polyester resins was added to form a shell over the particles. After the aggregation was completed, the particle dispersion was frozen with a chelation agent at pH about 8. The mixture was then heated up to 84° C. to coalesce. When the circularity reached 0.940, the batch was quenched at below 40° C. The resulting gold toner particles were washed with deionized water and freeze-dried to powder.

The fluorescent gold toner particles had about 20 weight % aluminum flakes, 0.5 weight % red fluorescent agent, and 2 weight % yellow fluorescent agent. A comparative gold toner was prepared, also using aluminum flakes (at 20 weight %), but with red and yellow pigments (at 7 weight % and 0.7 weight %, respectively) in place of the red/yellow fluorescent agents.

Toner Characterization. Toner particle size was analyzed from dry toner particles, exclusive of external surface additives, using a Beckman Coulter Multisizer 3 operated in accordance with the manufacturer's instructions. Representative sampling occurred as follows: a small amount of toner sample, about 1 gram, was obtained and filtered through a 25 μm screen, then put in isotonic solution to obtain a concentration of about 10%, with the sample then run in the multisizer. Circularity was analyzed from dry toner particles, exclusive of external surface additives, using a Sysmex 3000 operated in accordance with the manufacturer's instructions. The D50v size and circularity results are shown in Table 1, below.

TABLE 1

Toner Particle Characterization.

| | D50v | Circularity |
|---|---|---|
| Fluorescent Silver Toner | 11.07 | 0.950 |
| Comparative Silver Toner | 10.51 | 0.945 |
| Fluorescent Gold Toner | 12.17 | 0.950 |
| Comparative Gold Toner | 10.39 | 0.930 |

Toner particle morphology was analyzed from dry toner particles, exclusive of external surface additives, by SEM and TEM (data not shown). The images of the fluorescent silver and gold toner particles clearly showed the core-shell structure with complete aluminum flake encapsulation (no aluminum flakes are present at or on the surface of the particles or within the shell) and homogeneous aluminum flake distribution.

The optical properties of the fluorescent silver and fluorescent gold toners and comparative non-fluorescent silver and non-fluorescent gold toners were analyzed using an X-Rite ILS, operated in accordance with the manufacturer's instructions. For the fluorescent silver toners, a lightness L* of from 66 to 75 at a toner mass per area (TMA) of 0.45 $mg/cm^2$ to 0.85 $mg/cm^2$ was obtained. At the same time, a reflectance of 45 to 50 between wavelengths of 430 nm to 440 nm was obtained (the TMA was 0.45 $mg/cm^2$). For fluorescent gold toners, a lightness L* of from 65 to 71 at a toner mass per area (TMA) of 0.45 to 0.85 $mg/cm^2$ was obtained. At the same time, a reflectance of 30 to 50 between wavelengths of 430 nm to 440 nm was obtained (the TMA was 0.45 $mg/cm^2$). In addition, the reflectance of fluorescent gold prints is higher than that of non-fluorescent gold prints. More specifically, the reflectance of fluorescent gold prints was about 20 units higher between the wavelength of 500 nm to 520 nm and between 20-30 units higher between wavelengths of 550 nm to 600 nm (the TMA was 0.45 $mg/cm^2$).

Finally, the fluorescent silver and fluorescent gold toners emitted fluorescence under UV illumination. This fluorescence was measured and used to calculate the amount of fluorescent agent therein. This measured amount of fluorescent agent was compared to the theoretical amount of fluorescent agent (calculated based upon the amount used in the toner preparation process described above). This comparison showed that the measured amount was about the same as the theoretical amount. Together, these results confirm encapsulation and homogeneous distribution of the fluorescent agent without significant fluorescence quenching.

It will be appreciated that variants of the above-disclosed and other features and functions or alternatives thereof, may be combined into many other different systems or applications. Various presently unforeseen or unanticipated alternatives, modifications, variations or improvements therein may be subsequently made by those skilled in the art, which are also intended to be encompassed by the following claims.

What is claimed is:

1. A method of making a fluorescent metallic toner, the method comprising:

forming one or more fluorescent latexes which comprise a fluorescent agent, a first type of amorphous resin, and a second type of amorphous resin, wherein the first and second types of amorphous resins are present in the one or more fluorescent latexes at a weight ratio in a range of from 2:3 to 3:2;

forming a mixture comprising the one or more fluorescent latexes; a dispersion comprising aluminum flakes and a surfactant; one or more emulsions which comprise a crystalline resin, the first type of amorphous resin, the second type of amorphous resin; and optionally, a wax dispersion;

aggregating the mixture to form particles of a predetermined size;

forming a shell over the particles of the predetermined size to form core-shell particles; and coalescing the core-shell particles to form a fluorescent metallic toner, wherein the fluorescent metallic toner is a fluorescent gold toner and the one or more fluorescent latexes comprise a red fluorescent agent and a yellow fluorescent agent.

2. The method of claim 1, wherein the first and second types of amorphous resins are present in the one or more fluorescent latexes at the weight ratio of 1:1.

3. The method of claim 1, wherein the red fluorescent agent is selected from the group consisting of Solvent Red 49, Solvent Red 149, and combinations thereof and the yellow fluorescent agent is selected from the group consisting of Solvent Yellow 160:1, Solvent Yellow 172, Solvent Yellow 98, and combinations thereof.

4. The method of claim 3, wherein the crystalline polyester resin is a poly(1,6-hexylene-1,12-dodecanoate); the first type of amorphous polyester resin is a poly(propoxylated bisphenol-co-terephthlate-fumarate-dodecenylsuccinate); and the second type of amorphous polyester resin is a poly(propoxylated-ethoxylated bisphenol-co-terephthalate-dodecenylsuccinate-trimellitic anhydride).

5. The method of claim 4, wherein the fluorescent gold toner is characterized by a L* of at least 64 at a TMA of 0.65 mg/cm$^2$, a reflectance at a TMA of 0.45 mg/cm$^2$ of at least 30 between a wavelength range of from 500 nm to 600 nm, or both.

6. The method of claim 1, wherein the fluorescent metallic toner is a fluorescent gold toner characterized by a L* of at least 64 at a TMA of 0.65 mg/cm$^2$, a reflectance at a TMA of 0.45 mg/cm$^2$ of at least 30 between a wavelength range of from 500 nm to 600 nm, or both.

7. The method of claim 1, wherein the crystalline resin and the first and second types of amorphous resins are polyesters.

8. The method of claim 7, wherein the crystalline polyester resin has Formula I Formula I

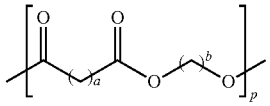

wherein each of a and b is in the range of from 1 to 12 and p is in the range of from 10 to 100.

9. The method of claim 7, wherein the crystalline polyester resin is a poly(1,6-hexylene-1,12-dodecanoate).

10. The method of claim 7, wherein the first type of amorphous polyester resin is a poly(propoxylated bisphenol-co-terephthlate-fumarate-dodecenylsuccinate) and the second type of amorphous polyester resin is a poly(propoxylated-ethoxylated bisphenol-co-terephthalate-dodecenylsuccinate-trimellitic anhydride).

11. A method of making a fluorescent metallic toner, the method comprising:

forming one or more fluorescent latexes which comprise a fluorescent agent, a first type of amorphous resin, and a second type of amorphous resin, wherein the first and second types of amorphous resins are present in the one or more fluorescent latexes at a weight ratio in a range of from 2:3 to 3:2;

forming a mixture comprising the one or more fluorescent latexes; a dispersion comprising aluminum flakes and a surfactant; one or more emulsions which comprise a crystalline resin, the first type of amorphous resin, the second type of amorphous resin; and optionally, a wax dispersion;

aggregating the mixture to form particles of a predetermined size;

forming a shell over the particles of the predetermined size to form core-shell particles; and coalescing the core-shell particles to form a fluorescent metallic toner, wherein fluorescent metallic toner is a fluorescent silver toner and the fluorescent agent is selected from the group consisting of Fluorescent Brightener 184, Fluorescent Brightener 185, Fluorescent Brightener 367, and combinations thereof.

12. The method of claim 11, wherein the fluorescent metallic toner is a fluorescent silver toner characterized by a L* of at least 66 at a toner mass per area (TMA) of 0.65 mg/cm$^2$, a reflectance at a TMA of 0.45 mg/cm$^2$ of at least 45 between a wavelength range of from 430 nm to 440 nm, or both.

13. The method of claim 11, wherein the crystalline polyester resin is a poly(1,6-hexylene-1,12-dodecanoate); the first type of amorphous polyester resin is a poly (propoxylated bisphenol-co-terephthlate-fumarate-dodecenylsuccinate); and the second type of amorphous polyester resin is a poly(propoxylated-ethoxylated bisphenol-co-terephthalate-dodecenylsuccinate-trimellitic anhydride).

14. The method of claim 13, wherein the fluorescent agent is present in the fluorescent latex in a range of from 1.5 weight % to 8 weight % by weight of the one or more fluorescent latexes.

15. The method of claim 13, wherein the fluorescent silver toner is characterized by a L* of at least 66 at a TMA of 0.65 mg/cm$^2$, a reflectance at a TMA of 0.45 mg/cm$^2$ of at least 45 between a wavelength range of from 430 nm to 440 nm, or both.

* * * * *